US006453896B2

(12) United States Patent
Takahashi et al.

(10) Patent No.: US 6,453,896 B2
(45) Date of Patent: Sep. 24, 2002

(54) AIR-FUEL RATIO FEEDBACK CONTROL APPARATUS AND METHOD OF INTERNAL COMBUSTION ENGINE

(75) Inventors: Koji Takahashi; Shigeo Ohkuma, both of Atsugi (JP)

(73) Assignee: Unisia Jecs Corporation, Kanagawa-Ken (JP)

( * ) Notice: Subject to any disclaimer, the term of this patent is extended or adjusted under 35 U.S.C. 154(b) by 1 day.

(21) Appl. No.: 09/810,605

(22) Filed: Mar. 19, 2001

(30) Foreign Application Priority Data

Mar. 17, 2000 (JP) ..... 2000-075266

(51) Int. Cl.[7] ..... F02D 41/14
(52) U.S. Cl. ..... 123/681; 701/109
(58) Field of Search ..... 123/681; 701/109

(56) References Cited

U.S. PATENT DOCUMENTS 5,535,135 A * 7/1996 Bush et al. ..... 123/672
5,845,491 A * 12/1998 Yasui et al. ..... 725/129

FOREIGN PATENT DOCUMENTS

JP 8-232713 9/1996

* cited by examiner

*Primary Examiner*—Erick Solis
(74) *Attorney, Agent, or Firm*—Sughrue Mion, PLLC

(57) ABSTRACT

A non-linear term $U_{NL}$ is computed as $U_{NL}$=gain $G_{NL}$×(air-fuel ratio detection value−target air-fuel ratio)/(|air-fuel ratio detection value−target air-fuel ratio|)+previous value $U_{NL}$ (OLD), and a linear term $U_L$ is computed as $U_L$=gain $G_L$×(air-fuel ratio detection value−target air-fuel ratio)/air-fuel ratio detection value. An addition of $U_{NL}$ and $U_L$ is set as an air-fuel ratio feedback correction coefficient to correct a fuel injection quantity. The gain $G_L$ is set a greater value as |air-fuel ratio detection value−target air-fuel ratio| becomes greater.

15 Claims, 4 Drawing Sheets

AIR-FUEL RATIO FEEDBACK CONTROL APPARATUS AND METHOD OF INTERNAL COMBUSTION ENGINE

FIELD OF THE INVENTION

The present invention relates to an air-fuel ratio feedback control apparatus and method of an internal combustion engine and especially to the technology for feedback controlling to a target air-fuel ratio an air-fuel ratio of a combustion mixture using a sliding mode control.

RELATED ART OF THE INVENTION

It is common to feedback control to a target value an air-fuel ratio of a combustion mixture for the purposes of purification of exhaust gas and improvement of fuel economy in an internal combustion engine for vehicle.

For the above mentioned air-fuel ratio feedback control, it is common that an air-fuel ratio is detected by an air-fuel ratio sensor disposed in an exhaust passage, and a fuel injection quantity is feedback controlled by a proportional control action, an integral control action and a derivative control action based upon an air-fuel ratio deviation so that a detection value of the air-fuel ratio to a target air-fuel ratio.

On the other hand, a sliding mode control is well known as a control with a high robust performance suppressing an influence of disturbance. A feedback control of an air-fuel ratio using this sliding mode control is disclosed in Japanese Unexamined Patent Publication 8-232713.

With an air-fuel ratio control apparatus disclosed in the above mentioned Japanese Unexamined Patent Publication No. 8-232713, an adaptation control and an observation control are used for quickly converging a large air-fuel ratio deviation. However, the adaptation control and observation control involves complicated control designs, respectively, and require a large memory capacities. Therefore, such controls are difficult to be applied to commercial vehicles.

SUMMARY OF THE INVENTION

The present invention has been made in view of the foregoing problems, and has an object of providing an air-fuel ratio feedback control apparatus and method using a sliding mode control, capable of quickly converging a large air-fuel ratio deviation with a simple control structure.

In order to achieve the above object, with the present invention, the construction is such that a non-linear term and a linear term are computed in order to approach a detection value of an air-fuel ratio of a combustion mixture to a target air-fuel ratio based upon the detection value of the air-fuel ratio of the combustion mixture and the target air-fuel ratio, the non-linear term and the inert term are added to be output as an air-fuel ratio feedback correction coefficient for correcting a fuel injection quantity, and a gain to be used for computing the linear term is set based upon a deviation between the detection value of the air-fuel ratio and the target air-fuel ratio.

According to this construction, the linear term is computed based upon the gain corresponding to the deviation between the detection value of the air-fuel ratio and the target air-fuel ratio. An air-fuel ratio feedback correction coefficient is computed from the linear term and the non-linear term computed separately. Then, the air-fuel ratio of the combustion mixture is corrected by correcting the fuel injection quantity with the air-fuel ratio feedback correction coefficient.

The gain to be used for computing the linear term may become greater, as an absolute value of the deviation between the detection value of the air-fuel ratio and the target air-fuel ratio becomes greater.

As described above, a correction amount by the linear term become s gore ter as the deviation becomes greater, by making the gain to be used of r compu ting the linear term greater as the deviation of an actual air-fuel ratio to the target air-fuel ratio becomes greater.

The non-linear term may be computed as follows;

$$U_{NL}=G_{NL}\times(\text{air-fuel ratio detection value}-\text{target air-fuel ratio})/(|\text{air-fuel ratio detection value}-\text{target air-fuel ratio}|)+U_{NL}(\text{OLD}),$$

wherein the non-linear term is $U_{NL}$, a previous value of the non-linear term is $U_{NL}$ (OLD) and a gain is $G_{NL}$.

According to the above equation, a switching line (S=0) is set as S=air-fuel ratio detection value−target air-fuel ratio, and the positive/negative of the gain $G_{NL}$ is switched whenever the air-fuel ratio crosses the switching line to be added to the non-linear term $U_{NL}$ up to the previous time.

Here a gain correction value for correcting the gain in the computation of the non-linear term may be computed in accordance with an engine intake air quantity.

The gain in the computation of the non-linear term is corrected in response to a change in a detection delay time of air-fuel ratio due to the intake air quantity. Since the delay time becomes longer as the intake air quantity is less, the gain to be used for computation of the non-linear term is made smaller as the intake air quantity is smaller, thereby avoiding overshoot.

The linear term may be computed as follows;

$$U_L-G_L\times(\text{air-fuel ratio detection value}-\text{target air-fuel ratio})/\text{air-fuel ratio detection value}$$

wherein the linear term is $U_L$ is and a gain is $G_L$.

The other objects and features of this invention will become understood from the following description with reference to the accompanying drawings.

DESCRIPTION OF THE PREFERRED EMBODIMENT

Figure 1:
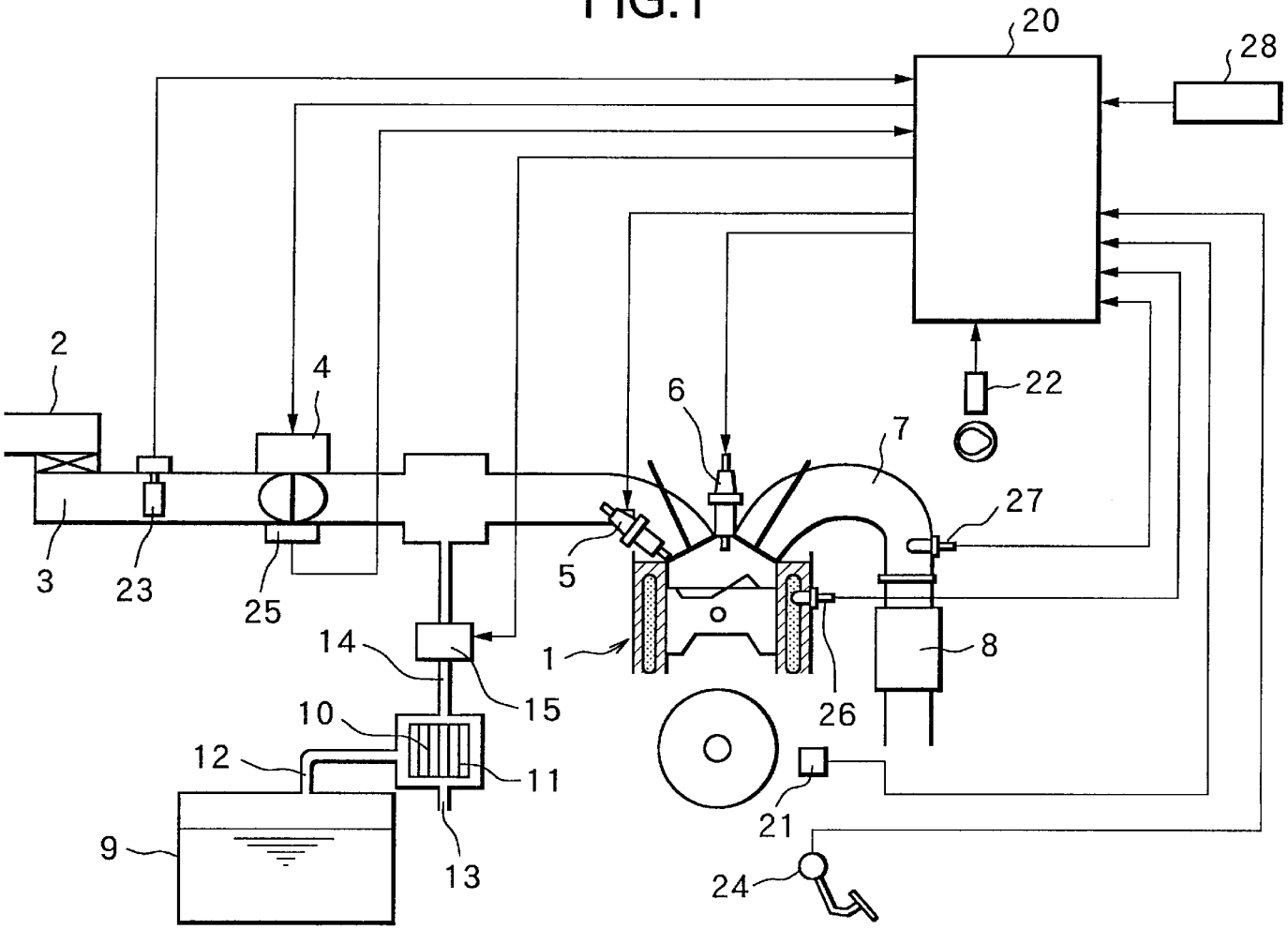
FIG. 1 is a diagram showing a system structure of an internal combustion engine according to one embodiment.

FIG. 1 is a diagram of a system structure of an internal combustion engine in one embodiment.

In FIG. 1, air is sucked into a combustion chamber of each cylinder in an internal combustion engine 1 mounted on a vehicle via an air cleaner 2, an intake passage 3, and an electronically controlled throttle valve 4 driven to open or close by a motor. An electromagnetic fuel injection valve 5 A is disposed in the combustion chamber of each cylinder for injecting fuel into the combustion chamber directly. An air-fuel mixture is formed in the combustion chamber by the fuel injected from the fuel injection valve 5 and the sucked air.

The fuel injection valve 5 is driven to open with the power supply to a solenoid thereof by an injection pulse signal output from a control unit 20, to inject fuel adjusted at a predetermined pressure. The injected fuel, in case of an intake stroke injection, is diffused into the combustion chamber to form a homogeneous airfuel mixture and, in case of a compression stroke injection, forms a stratified air-fuel mixture concentrated around an ignition plug 6. The air-fuel mixture formed in the combustion chamber is ignited and combusted by the ignition plug 6.

The internal combustion engine 1 is not limited to the above mentioned direct injection gasoline engine and may be an engine of a construction for injecting fuel into an intake port.

The exhaust from the engine 1 is discharged from an exhaust passage 7. A catalytic converter 8 for exhaust purification is disposed in the exhaust passage 7.

Further, there is provided a fuel vapor processing device for performing a combustion processing of fuel vapor generated in a fuel tank 9.

A canister 10 is a closed container filled with an adsorbent 11 such as active carbon, and is connected to a fuel vapor conduit 12 extending from the fuel tank 9.

Accordingly, the fuel vapor generated in the fuel tank 9 passes through the fuel vapor conduit 12 and is introduced to the canister 10 to be adsorbed and collected therein.

The canister 10 is provided with a new air introduction opening 13 and a purge pipe 14 is extended from the canister 10. The purge pipe 14 is disposed with a purge control valve 15 that is driven to open or close by a control signal from the control unit 20.

In the above construction, when the purge control valve 15 is controlled to open, as a result that a negative intake pressure of the engine 1 acts on the canister 10, the fuel vapor adsorbed to the adsorbent 11 in the canister 10 is purged by air introduced from the new air introduction opening 13, and the purged air passes through the purge pipe 14 to be sucked to the downstream of the throttle valve 4 disposed in the intake passage 3, and then is subjected to combustion processing in the combustion chamber of the engine 1.

The control unit 20 is equipped with a microcomputer comprising a CPU, a ROM, a RAM, an A/D converter, an inputoutput interface and so forth. The control unit 20 receives input signals from various sensors, and performs computation based upon these signals, to control operations of the fuel injection valve 5, the ignition plug 6, the purge control valve 15 and the like.

For the various sensors, there are provided a crank angle sensor 21 for detecting a crank angle of the engine 1 and a cam sensor 22 for taking a cylinder discrimination signal out of a camshaft. The rotation speed of the engine is computed based upon a signal from the crank angle sensor 21.

In addition, there are provided an air flow meter 23 for detecting an intake air quantity Qa on the upstream of the throttle valve 4 of the intake passage 3, an accelerator sensor 24 for detecting a depression amount of an accelerator pedal (accelerator opening) APS, a throttle sensor 25 for detecting an opening degree TVO of the throttle valve 4, a water temperature sensor 26 for detecting the cooling water temperature Tw of the engine 1, a wide range type air-fuel ratio sensor 27 for linearly detecting an air-fuel ratio of a combustion mixture in accordance with an oxygen concentration in the exhaust, and a vehicle speed sensor 28 for detecting a vehicle speed VSP.

Figure 2:
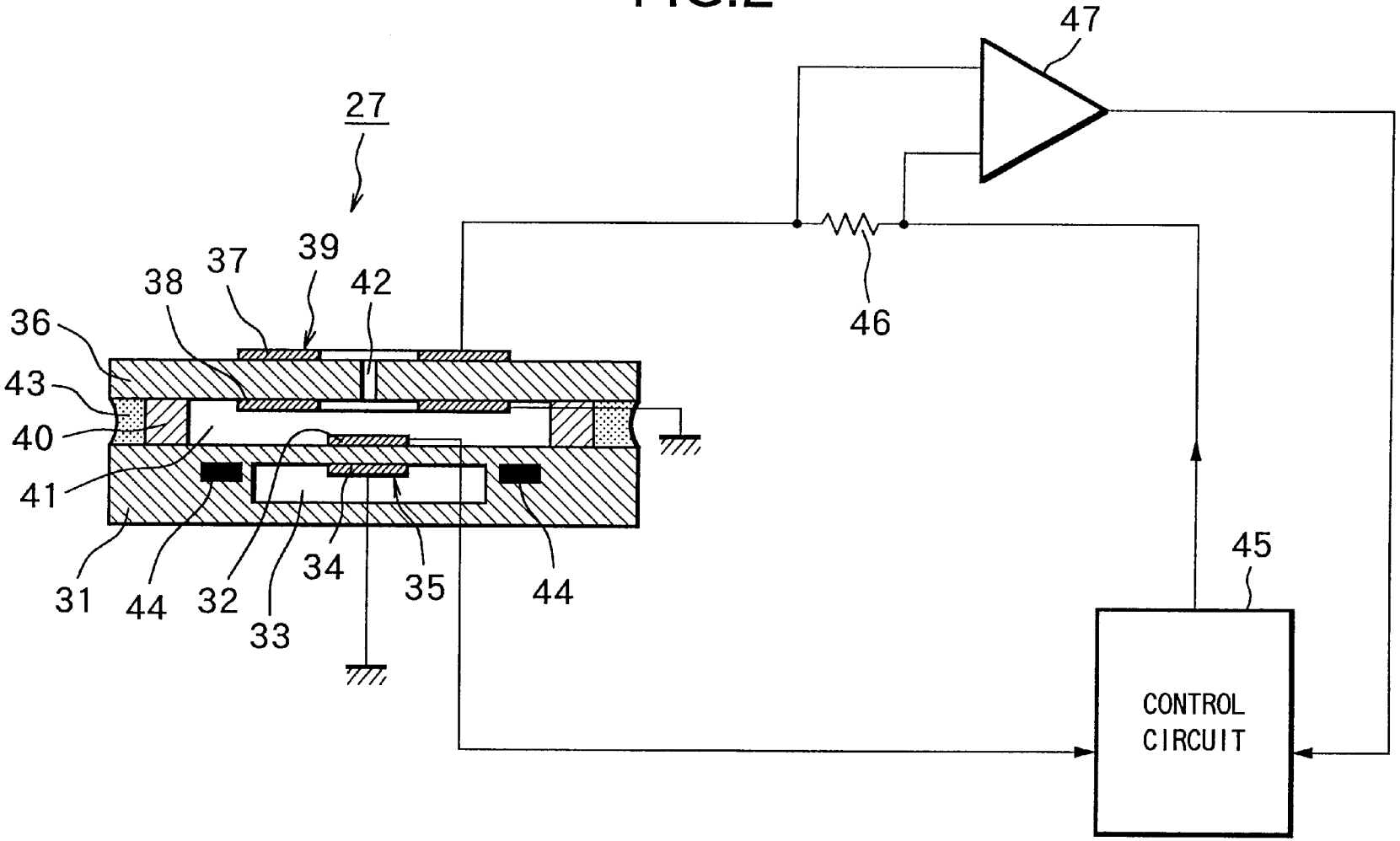
FIG. 2 is a diagram showing an air-fuel ratio sensor and its peripheral circuit in the embodiment.

Here, the structure of the wide range type air-fuel ratio sensor 27 will be explained based upon FIG. 2.

On a substrate 31 made of a solid electrolyte member, such as zirconia (ZrO2), is disposed a positive electrode 32 for measuring oxygen concentration. The substrate 31 is formed with an atmosphere introduction hole 33 to which atmosphere is introduced. A negative electrode 34 is mounted on to the substrate 31 opposed to the positive electrode 32.

Thus, an oxygen concentration detection unit is made up of the substrate 31, the positive electrode 32 and the negative electrode 34.

Moreover, an oxygen pump unit 39 is formed, comprising a pair of pump electrodes 37, 38 made of platinum placed on both faces of a solid electrolyte member 36 made of zirconia or the like.

The oxygen pump unit 39 is laid via a frame-shaped spacer 40 formed of alumina over the oxygen concentration detection unit 35, and a hollow chamber 41 is formed between the oxygen concentration detection unit 35 and the oxygen pump unit 39. An introduction hole 42 for introducing the engine exhaust into the hollow chamber 41 is formed in the solid electrolyte member 36 of the oxygen pump unit 39.

A periphery of the spacer 40 is filled with a glass adhesive agent 43, thereby securing a sealing performance of the hollow chamber 41 and adhesively fixing together the substrate 31, the spacer 40 and the solid electrolyte member 36. Since the spacer 40 and the substrate 31 are bonded together by simultaneous baking, the sealing performance of the hollow chamber 41 is secured by bonding the spacer 40 and the solid electrolyte member 36. A heater 44 for warm-up is incorporated in the oxygen concentration detection unit 39.

An oxygen concentration of the exhaust introduced into the hollow chamber 41 via the introduction hole 42 is detected based upon a voltage of the positive electrode 32. Specifically, an oxygen ion current flows through the substrate 31 in accordance with a difference in concentration between the oxygen in the atmosphere in the atmosphere introduction hole 33 and the oxygen of the exhaust in the hollow chamber 41. With this current flow, a voltage corresponding to the oxygen concentration in the exhaust is generated in the positive electrode 32.

A value of the current flowing through the oxygen pump unit 39 is variably controlled to maintain the atmosphere in the hollow chamber 41 to be constant (for example, theoretical air-fuel ratio) depending upon the detection result and the oxygen concentration of the exhaust is detected based upon the current value at that time.

Specifically, after the voltage of the positive electrode 32 is amplification processed by a control circuit 45, the amplified voltage is applied via a voltage detection resistor 46 between an electrode 37 and an electrode 38 for maintaining the oxygen concentration of the hollow chamber 41 to be constant.

For example, when detecting an air-fuel ratio in a lean region where the oxygen concentration in the exhaust is high, the outer pump electrode 37 is set as anode and the pump electrode 38 of the hollow chamber 41 side is set as cathode, to apply the voltage. Then, oxygen (oxygen ion $O^{2-}$) in proportion to the current is pumped out from the hollow chamber 41 to the exterior. When the applied voltage reaches a predetermined value or above, the flowing current reaches a limit value. By measuring this limit value by the control circuit 45, the oxygen concentration in the exhaust, i e., an air-fuel ratio, can be detected.

On the contrary, If oxygen is pumped into the hollow chamber 41, by setting the pump electrode 37 as cathode and the pump electrode 38 as anode, the air-fuel ratio can be detected in a rich region where the oxygen concentration in the exhaust is low.

This limit current is detected on the basis of an output voltage from a differential amplifier 47 for detecting a voltage between terminals of the voltage detection resister 46.

The control unit performs an air-fuel ratio feedback control by a sliding mode control according to the present invention so that the air-fuel ratio detected by the air-fuel ratio sensor 27 coincides a target air-fuel ratio in accordance with an operating condition when a predetermined air-fuel ratio control condition is established.

Figure 3:
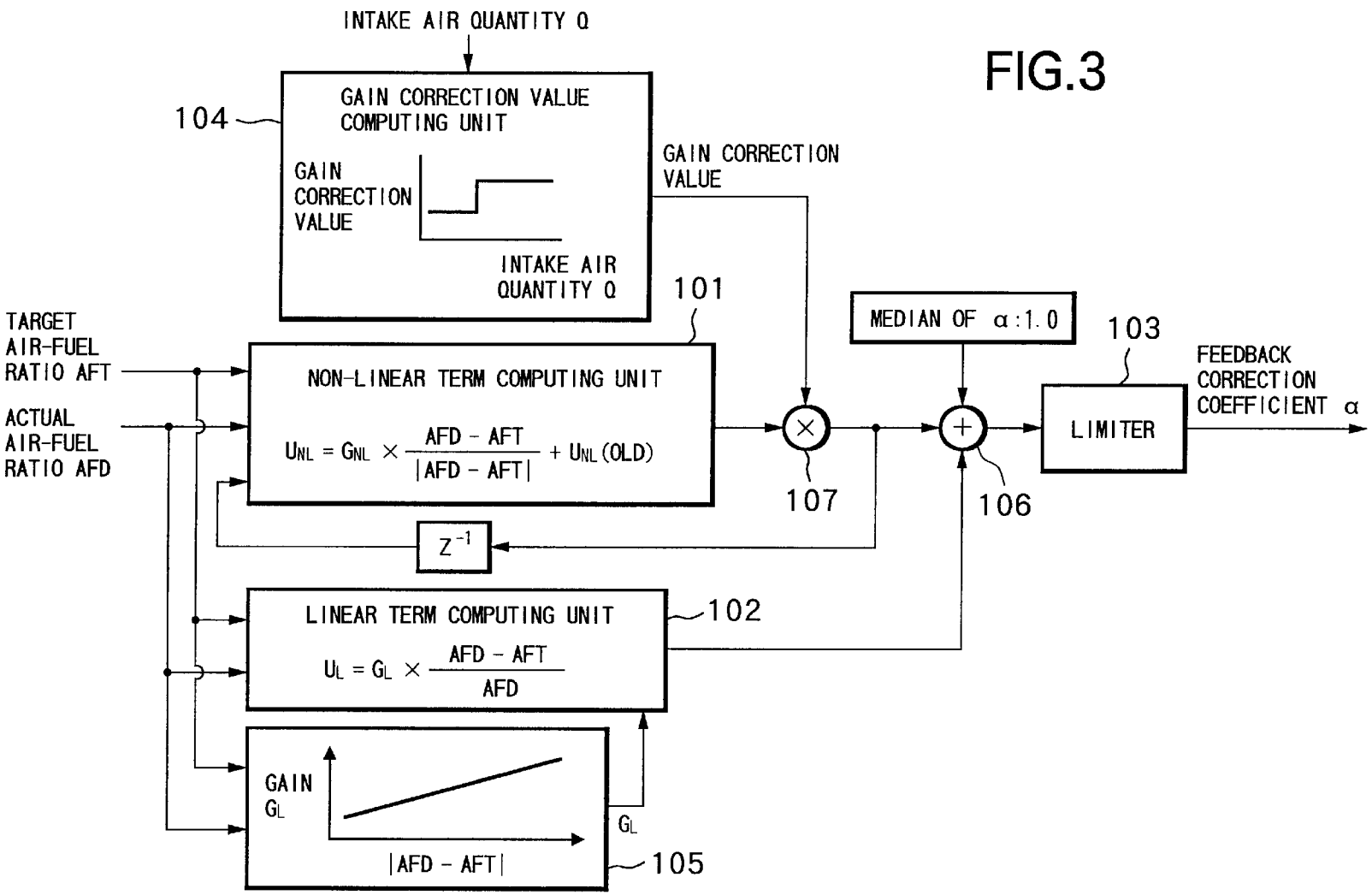
FIG. 3 is a control block diagram showing an air-fuel ratio feedback control operation in the embodiment.

FIG. 3 is a block diagram showing the air-fuel ration feedback control by the sliding mode control.

At a non-linear term computation unit 101, a non-linear term $U_{NL}$ for obtaining an air-fuel ratio feedback control correction coefficient $\alpha$ is computed according to the following equation;

$$U_{NL}=G_{NL}\times(AFD-AFT)/(|AFD-AFT|)+U_{NL}(OLD),$$

wherein $G_{NL}$ is a gain determined in advance, AFT is a target value of air-fuel ratio set in accordance with the engine operating condition at that time, AFD is an actual air-fuel ratio detected by the air-fuel ratio sensor 27 at that time, and $U_{NL}$ (OLD) is a previous value of the non-linear term $U_{NL}$ In the sliding mode control in this embodiment, a switching function S is set as switching function S=air-fuel ratio detection value AFD−target air-fuel ratio AFT by a direct switching function method, so that the switching line (S=0) shows the air-fuel ratio detection value AFD=the target air-fuel ratio AFT, being a desired state, thereby the increase/decrease direction (positive/negative) of the gain $G_{NL}$ is switched whenever the air-fuel ratio crosses the switching line. Then, the non-linear term $U_{NL}$ is computed as a value obtained by integrating the gain $G_{NL}$ the increase/decrease direction (positive/negative) of which is switched at the switching line (S=0).

At a linear term computation unit 102, a linear term $U_L$ for obtaining the air-fuel ratio feedback correction coefficient $\alpha$ is computed according to the following equation;

$$U_L=G_L\times(AFD-AFT)/AFD.$$

In this equation, $G_L$ is a gain set at a gain setting unit 105 described later.

At an addition unit 106, the linear term $U_L$ and the non-linear term $U_{NL}$ are added and further the median (=1.0) of the air-fuel ratio feedback correction coefficient $\alpha$ is added to the addition result to be output to a limiter 103 as an air-fuel ratio feedback correction coefficient $\alpha$.

At the limiter 103, after the air-fuel ratio feedback correction coefficient $\alpha$ is controlled to be limited within an upper limit and a lower limit, the air-fuel ratio feedback correction coefficient $\alpha$ is output as a final air-fuel ratio feedback correction coefficient $\alpha$.

By multiplying the air-fuel ratio correction coefficient $\alpha$ to a basic fuel injection quantity Tp (equivalent to a theoretical air-fuel ratio) computed in accordance with the intake air quantity and the engine rotation speed, the fuel injection quantity is qcorrected a fuel injection quantity equal to the target air-fuel ratio at that time to be set as a final fuel injection quantity Ti. The fuel is injected by outputting to the fuel injection valve 5 a fuel injection pulse signal of a pulse width equivalent to the fuel injection quantity Ti.

A gain correction value computation unit 104 is provided for correcting the gain $G_{NL}$ of the non-linear term $U_{NL}$ in response to a change in the detection delay time of air-fuel ratio depending upon the engine operation condition. A gain correction value is set for correcting the gain $G_{NL}$ to a smaller value in the engine operation condition in which the delay time becomes longer (for example, when the intake air quantity becomes smaller).

At a multiplication unit 107, the non-linear term $U_{NL}$ is corrected by multiplying the gain correction value to the non-linear term $U_{NL}$ computed at the non-linear term computation unit 101.

Further, a gain setting unit 105 is provided for setting the gain $G_L$ to a greater value when the absolute value of the deviation between the air-fuel ratio detection value AFD and the target air-fuel ratio AFT (|air-fuel ratio detection value AFD−target air-fuel ratio AFT|) becomes greater.

In this way, a convergence performance to the target air-fuel ratio AFT is enhanced by a higher computation gain of the linear term $U_L$ when the air-fuel ratio detection value AFD is deviated largely from the target air-fuel ratio AFT.

Figure 4:
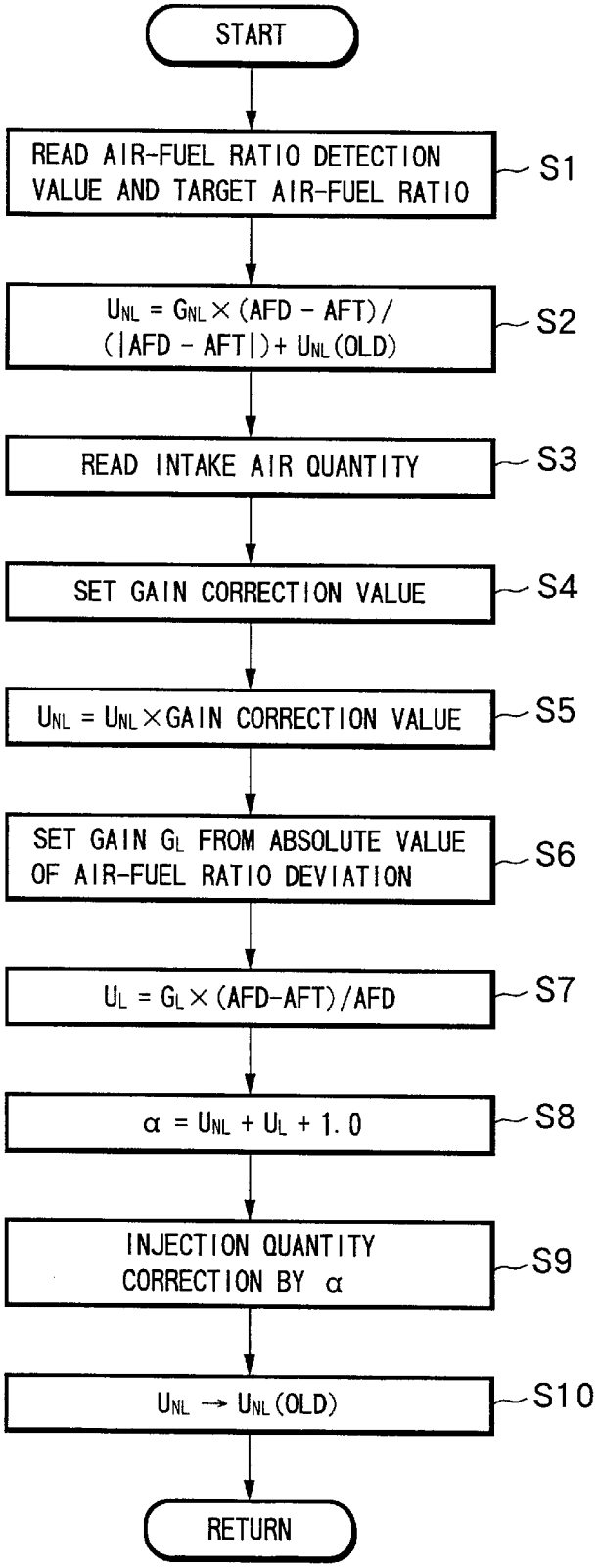
FIG. 4 is a flowchart showing a flow of an air-fuel ratio feedback control routine in the embodiment.

A flowchart in FIG. 4 shows a state of air-fuel feedback control by the sliding mode control. At Step S1, the actual air-fuel ratio AFD detected by the air-fuel ratio sensor 27 and the target air-fuel ratio AFT are read.

At Step S2, the non-linear term $U_{NL}$ is computed on the provision of;

$$U_{NL}=G_{NL}\times(AFD-AFT)/(|AFD-AFT|)+U_{NL}(OLD).$$

At Step S3, the intake air quantity of the engine is read as the engine operation condition.

At Step S4, a gain correction value is set based upon the read intake air quantity, and at next Step S5, the non-linear term $U_{NL}$ is correctingly set by multiplying the gain correction value by the non-linear term $U_{NL}$ computed at Step S2.

At Step S6, the gain $G_L$ for use in computing a linear term $U_L$ is set in accordance with an absolute value of the deviation between the air-fuel ratio detection value AFD and the target air-fuel ratio AFT.

At Step S7, the linear term $U_L$ is computed by using the gain $G_L$ according to the following equation.

$$U_L=G_L\times(AFD-AFT)/AFD$$

At Step S8, the air-fuel ratio feedback correction coefficient $\alpha$ is computed as $\alpha=U_{NL}+U_L+1.0$.

At Step S9, the fuel injection quantity is corrected by the air-fuel ratio feedback correction coefficient $\alpha$.

At Step S10, the computed non-linear term $U_{NL}$ is set to the previous value $U_{NL}$ (OLD) in preparation for the next computation.

The entire contents of japanese patent application no. 2000-075266, filed on Mar. 17, 2000, is incorporated herein by reference.

What is claimed is:

1. An air-fuel ratio feedback control apparatus of an internal combustion engine, comprising:

a non-linear term computation unit for computing a non-linear term in order to approach a detection value of an air-fuel ratio of a combustion mixture to a target airfuel ratio based upon the detection value of the air-fuel ratio of the combustion mixture and the target air-fuel ratio;

a linear term computation unit for computing a linear term in order to approach the detection value of the air-fuel ratio of the combustion mixture to the target air-fuel ratio based upon the detection value of the air-fuel ratio of the combustion mixture and the target air-fuel ratio;

a gain setting unit for setting a gain in said linear term computation unit based upon a deviation between the air-fuel ratio detection value and the target air-fuel ratio; and an addition unit for adding said non-linear term and said linear term and outputting the addition result as an air-fuel ratio correction coefficient for correcting a fuel injection quantity.

2. An air-fuel ratio feedback control apparatus of an internal combustion engine according to claim 1, wherein said gain setting unit sets said gain in said linear term computation unit greater as an absolute value of the deviation between said air-fuel ratio detection value and said target air-fuel ratio becomes greater.

3. An air-fuel ratio feedback control apparatus of an internal combustion engine according to claim 1, wherein said non-linear term computation unit computes a non-linear term $U_{NL}$ as $$U_{NL}=G_{NL}\times(\text{air-fuel ratio detection value}-\text{target air-fuel ratio})/(|\text{air-fuel ratio detection value}-\text{target air-fuel ratio}|)+U_{NL}(\text{OLD}),$$

When said non-linear term is $U_{NL}$, a previous value of the non-linear term is $U_{NL}$ (OLD) and a gain is $G_{NL}$.

4. An air-fuel ratio feedback control apparatus of an internal combustion engine according to claim 1, further comprising;

a gain correction value computation unit for computing a gain correction value for correcting the gain in said non-linear term computation unit in accordance with an intake air quantity of the engine.

5. An air-fuel ratio feedback control apparatus of an internal combustion engine according to claim 4, wherein said gain correction value computation unit computes said gain correction value so that the gain in said non-linear term computation unit is corrected to become smaller as the intake air quantity becomes smaller.

6. An air-fuel ratio feedback control apparatus of an internal combustion engine according to claim 1, wherein said linear term computation unit computes a linear term $U_L$ as $$U_L=G_L\times(\text{air-fuel ratio detection value}-\text{target air-fuel ratio})/\text{air-fuel ratio detection value}$$

when said linear term is $U_L$ is and a gain is $G_L$.

7. An air-fuel ratio feedback control apparatus of an internal combustion engine according to claim 1, further comprising;

a limiter for limiting said air-fuel ratio correction coefficient within an upper limit and a lower limit.

8. An air-fuel ratio feedback control apparatus of an internal combustion engine according to claim 1, further comprising;

an air-fuel ratio sensor for det ecting in a wide range the air-fuel ratio of said combustion mixture based on an oxygen concentration in the exhaust.

9. An air-fuel ratio feedback control apparatus of an internal combustion engine, comprising:

a non-linear term computation unit for computing a non-linear term $U_{NL}$ as $$U_{NL}=G_{NL}\times(\text{air-fuel ratio detection value}-\text{target air-fuel ratio})/(|\text{air-fuel ratio detection value}-\text{target air-fuel ratio}|)+U_{NL}(\text{OLD}),$$

when a non-linear term is $U_{NL}$, a previous value of said non-linear term is $U_{NL}$ (OLD) and a gain is $G_{NL}$;

a linear term computation unit for computing a linear term $U_L$ as $$U_L=G_L\times(\text{air-fuel ratio detection value}-\text{target air-fuel ratio})/\text{lair-fuel ratio detection value}$$

when said linear term is $U_L$ is and a gain is $G_L$;

a gain setting unit for setting said gain $G_L$ greater as an absolute value of a deviation between said air-fuel ratio detection value and said target air-fuel ratio becomes greater; and an addition unit for adding said non-linear term $U_{NL}$ and said linear term $U_L$ and outputting the addition result as an air-fuel ratio correction coefficient for correcting a fuel injection quantity.

10. An air-fuel ratio feedback control method of an internal combustion engine, comprising the steps of:

computing a non-linear term in order to approach a detection value of an air-fuel ratio of a combustion mixture to a target air-fuel ratio based upon the detection value of the air-fuel ratio of the combustion mixture and the target air-fuel ratio;

setting a gain to be used for computing a linear term based upon a deviation between the air-fuel ratio detection value and the target air-fuel ratio;

computing a linear term in order to approach the detection value of the air-fuel ratio of the combustion mixture to the target air-fuel ratio based upon the detection value of the air-fuel ratio of the combustion mixture and the target air-fuel ratio; and adding said non-linear term and said linear term and outputting the addition result as an air-fuel ratio correction coefficient for correcting a fuel injection quantity.

11. An air-fuel ratio feedback control method of an internal combustion engine according to claim 10, wherein said gain setting step sets said gain to be used for computing said linear term greater as an absolute value of the deviation between said air-fuel ratio detection value and said target air-fuel ratio becomes greater.

12. An air-fuel ratio feedback control method of an internal combustion engine according to claim 10, wherein said non-linear term computation step computes a non-linear term $U_{NL}$ as $$U_{NL}=G_{NL}\times(\text{air-fuel ratio detection value}-\text{target air-fuel ratio})/(|\text{air-fuel ratio detection value}-\text{target air-fuel ratio}|)+U_{NL}(\text{OLD}),$$

When said non-linear term is $U_{NL}$, a previous value of the non-linear term is $U_{NL}$ (OLD) and a gain is $G_{NL}$.

13. An air-fuel ratio feedback control method of an internal combustion engine according to claim 10, further comprising the step of;

computing a gain correction value for correcting the gain to be used for computing said non-linear term in accordance with an intake air quantity of the engine.

14. An air-fuel ratio feedback control method of an internal combustion engine according to claim 13, wherein said gain correction value computation step computes said gain correction value so that the gain to be used for computing said non-linear term is corrected to become smaller as the intake air quantity becomes smaller.

15. An air-fuel ratio feedback control method of an internal combustion engine according to claim 10, wherein said linear term computation step computes a linear term $U_L$ as $$U_L=G_L\times(\text{air-fuel ratio detection value}-\text{target air-fuel ratio})/\text{air-fuel ratio detection value}$$

when said linear term is $U_L$ is and a gain is $G_L$.

* * * * *